US008176819B2

(12) United States Patent
Rydh

(10) Patent No.: US 8,176,819 B2
(45) Date of Patent: May 15, 2012

(54) COLLISION SENSING DEVICE

(75) Inventor: Jan Rydh, Ronneby (SE)

(73) Assignee: Water Jet Sweden AB, Ronneby (SE)

( * ) Notice: Subject to any disclaimer, the term of this patent is extended or adjusted under 35 U.S.C. 154(b) by 318 days.

(21) Appl. No.: 12/602,978

(22) PCT Filed: Mar. 17, 2008

(86) PCT No.: PCT/SE2008/050292

§ 371 (c)(1),
(2), (4) Date: Jan. 21, 2010

(87) PCT Pub. No.: WO2008/115137

PCT Pub. Date: Sep. 25, 2008

(65) Prior Publication Data

US 2010/0175528 A1 Jul. 15, 2010

(30) Foreign Application Priority Data

Mar. 20, 2007 (SE) ..... 0700692

(51) Int. Cl.
*B26D 7/22* (2006.01)

(52) U.S. Cl. ..... 83/62; 83/98; 83/177; 83/DIG. 1

(58) Field of Classification Search ..... 83/522.11, 83/522.12, 522.14, 22, 24, 57, 58, 61–63, 83/66, 67, 100, 177, 639.1–639.3, DIG. 1; 73/862.636, 714, 715

See application file for complete search history.

(56) References Cited

U.S. PATENT DOCUMENTS 3,877,334 A * 4/1975 Gerber ..... 83/22
4,756,480 A 7/1988 Fish
5,366,156 A 11/1994 Bauer et al.
6,357,565 B1 * 3/2002 Bolledi et al. ..... 188/371
6,379,214 B1 * 4/2002 Stewart et al. ..... 451/2
2001/0018855 A1 9/2001 Sciulli
2002/0124701 A1 * 9/2002 Caspar et al. ..... 83/100
2003/0037654 A1 * 2/2003 Sciulli et al. ..... 83/177

FOREIGN PATENT DOCUMENTS

EP 1004395 A2 5/2000
EP 1004395 A3 5/2000
WO WO 2008/115137 A1 9/2008

OTHER PUBLICATIONS

International Search Report from corresponding International Application No. PCT/SE2008/050292 dated Mar. 12, 2008.

* cited by examiner

*Primary Examiner* — Phong Nguyen
(74) *Attorney, Agent, or Firm* — Alston & Bird LLP

(57) ABSTRACT

The invention relates to a collision sensing device which can detect a collision between two or more objects. The collision sensing device comprises a deformable member (5) that defines a space (15) which can be assigned a pressure. In a first condition, the deformable member is undeformed, whereby the space (15) is assigned a first pressure (P1). In a second condition, the deformable member (5) is deformed whereby the space (15) is assigned a second pressure (P2). The pressure in the space is monitored. A collision with an object is detected when the pressure in the space changes from the first pressure to the second pressure.

The invention can e.g. be applied in connection with machining, such as water jet cutting, but several other fields of application are also conceivable.

11 Claims, 3 Drawing Sheets

COLLISION SENSING DEVICE

FIELD OF INVENTION

The invention relates to a collision sensing device, which is adapted to detect a collision between two or more objects. The invention also relates to an apparatus for machining that comprises said collision sensing device.

In many situations, it is desirable to detect a collision between objects. One purpose can be avoiding collisions. The invention is directed towards detecting a collision between a tool and an obstacle in a workpiece during machining. Machining is here intended to in particular comprise all sorts of cutting machining such as water jet cutting, gas cutting, plasma cutting, laser cutting et cetera. During the machining it can on the one hand be desired to protect the tool, e.g. a nozzle of some kind, from damage due to a collision with an obstacle such as an unevenness in the workpiece. On the other hand, it can be desired to protect parts of the workpiece from damage due to collisions with a tool. The invention can also used in other situations, such as vehicles, in particular in connection with parking of vehicles.

A traditional way of protecting objects is to provide them with a shock absorbing protection of flexible material.

In U.S. Pat. No. 5,366,156 A is described how an object is cleaned by means of an aerosol which is directed at the surface of the object by a nozzle 202. The nozzle is provided with a protecting coating 265 (FIG. 8) in order to protect the object against damage by accidental contact with the nozzle. Such a coating can only provide a limited protection. In case the nozzle is guided with great force, for instance, there is a risk that the nozzle is bent as a result of collision with an object. Also the object may be may be damaged. Further, U.S. Pat. No. 5,366,156 A does not provide for a detection of the collision.

On vehicles, such as cars, bumpers provide a corresponding protection. When it comes to vehicles, collisions can also be avoided by means of more sophisticated equipment, such as so called backup sensors that alert when obstacles approach. Here, use is made of ultrasound which is reflected against the obstacle. A technique of this kind is relatively expensive. Further, a plurality of sensors must be installed in order to protect an object in all directions. Moreover, the sensors are sensitive to dirt, humidity and mechanical influences.

In connection with machining, collision sensing devises incorporating electrical switches that signal collisions have been put to use. However, this solution has not led to satisfying results. This is partly because these collisions sensing devises often have been damaged due to mechanical influences, and partly because they have been expensive owing to a relatively complex design construction.

Thus, there is a need for a collision sensing device that is reliable, has a relatively simple construction, can endure dirt and mechanical influences, and is independent of the form of the obstacle.

SUMMARY OF THE INVENTION

The present invention relates to a collision sensing device, such as may be used in a water jet cutting apparatus, which can detect a collision between two or more objects. The collision sensing device comprises a deformable member which defines a space that can be assigned a pressure. In a first condition, the deformable member is undeformed whereby the space is assigned a first pressure. In a second condition, the deformable member is deformed whereby the space is assigned a second pressure. Upon collision of the deformable member with an object, the deformable member is deformed into the second condition, whereby the pressure in the space changes from the first pressure to the second pressure. The collision sensing means further comprises a means for detecting the pressure change. The first pressure is preferably an overpressure. Thereby is prevented that dirt or other unwanted material enters the space. The second pressure is lower than the first pressure. The collision sensing device can also include a pressure generator for providing the space said overpressure through an opening in the boundary surface of the space.

In the first condition, i.e. when the deformable member is undeformed, the space is preferably closed. After the deformation of the deformable member, i.e. to the second condition, the space is preferably not closed. As a consequence, the second pressure will be closer to the ambient pressure than is the first pressure.

The deformable member may be configured as a splatter shield which has the form of a frustum of a cone with circular cross-section. The cone is arranged with its wider end towards a workpiece. Hereby a relatively large detection or sensing area is obtained, within which a collision with one or more objects is detected. The splatter shield can also take other forms. The splatter shield can e.g. be of rectangular cross-section, or be tubular. The space that is assigned the pressure is defined by the upper side of the splatter shield, a bulge enclosing the upper side of the splatter shield and also a support plate which is sealingly arranged against the bulge. In this manner, a collision sensing device of simple construction in achieved.

The invention further relates to an apparatus for machining where the apparatus comprises said collision sensing device. The machining is preferably water jet cutting.

DETAILED DESCRIPTION OF THE INVENTION

Below, an embodiment of the invention is described with reference to the enclosed figures. The embodiment merely serves as an example of an application of the invention, and is not intended to limit the claimed scope, which is defined by the independent claims.

Figure 1:
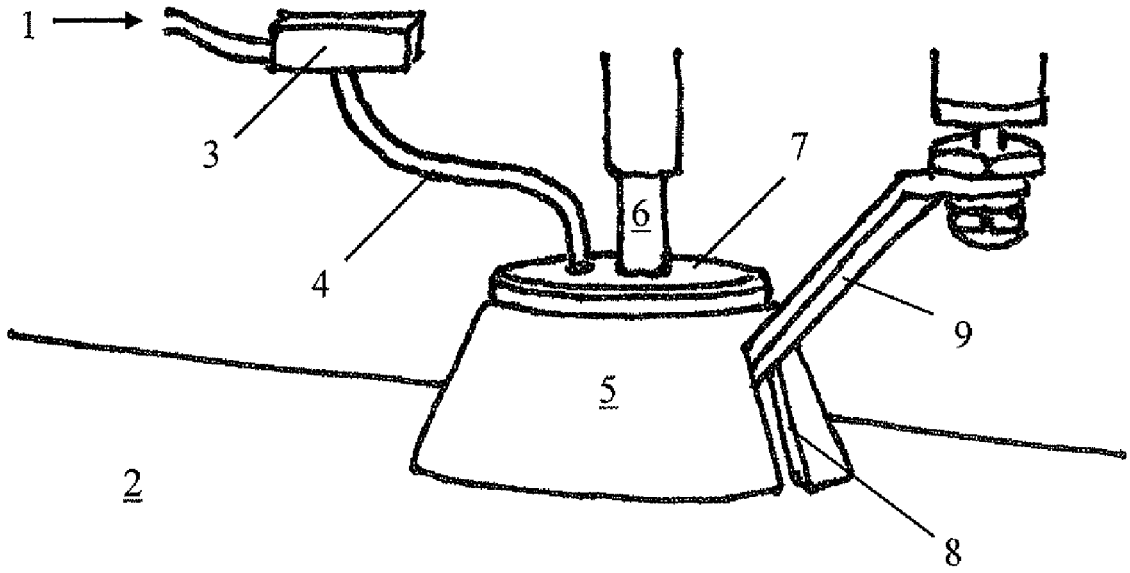
FIG. 1 shows a schematical sketch of the invention in perspective.

A preferred embodiment of the invention is shown in FIG. 1, where the collision sensing devise is adapted for use in water jet cutting. In this apparatus for water jet cutting a splatter shield 5 is utilized as deformable member, which encloses a nozzle 6 for water jet cutting. The splatter shield 5 comprises a side wall and an upper part. The side wall of the splatter shield 5 is formed as a frustum of a cone, se also FIGS. 2 and 3. The cone has a wider end and a narrower end. The wider end, which is turned downwards in the figures, is open and is during machining located just above the surface of the workpiece 2. The edge 11 of the wider end is located closer to the surface of the workpiece 2 than is the end of the nozzle 6, or, the edge 11 of the wider end is located at the same distance from the surface of the workpiece as is the end of the nozzle 6. The narrower end, i.e. the upper part 20 of the splatter shield that is turned upwards in the figures, is closed with exception for a central opening 10 which is intended for the water jet cutting nozzle 6 (below referred to as "nozzle").

During the water jet cutting the splatter shield 5 is arranged around the nozzle 6 and retained in an appropriate manner, e.g. by force fit. The diameter of the central opening 10 is then made somewhat smaller than the diameter of the nozzle 6. The primary task of the splatter shield is to hinder material and water splatter from the machining process. The splatter shield is manufactured from a soft flexible material, such as rubber with a Shore hardness within the range 75-95, preferably the Shore hardness is within the range 85-95, more preferably the Shore hardness is around 90.

Figure 2:
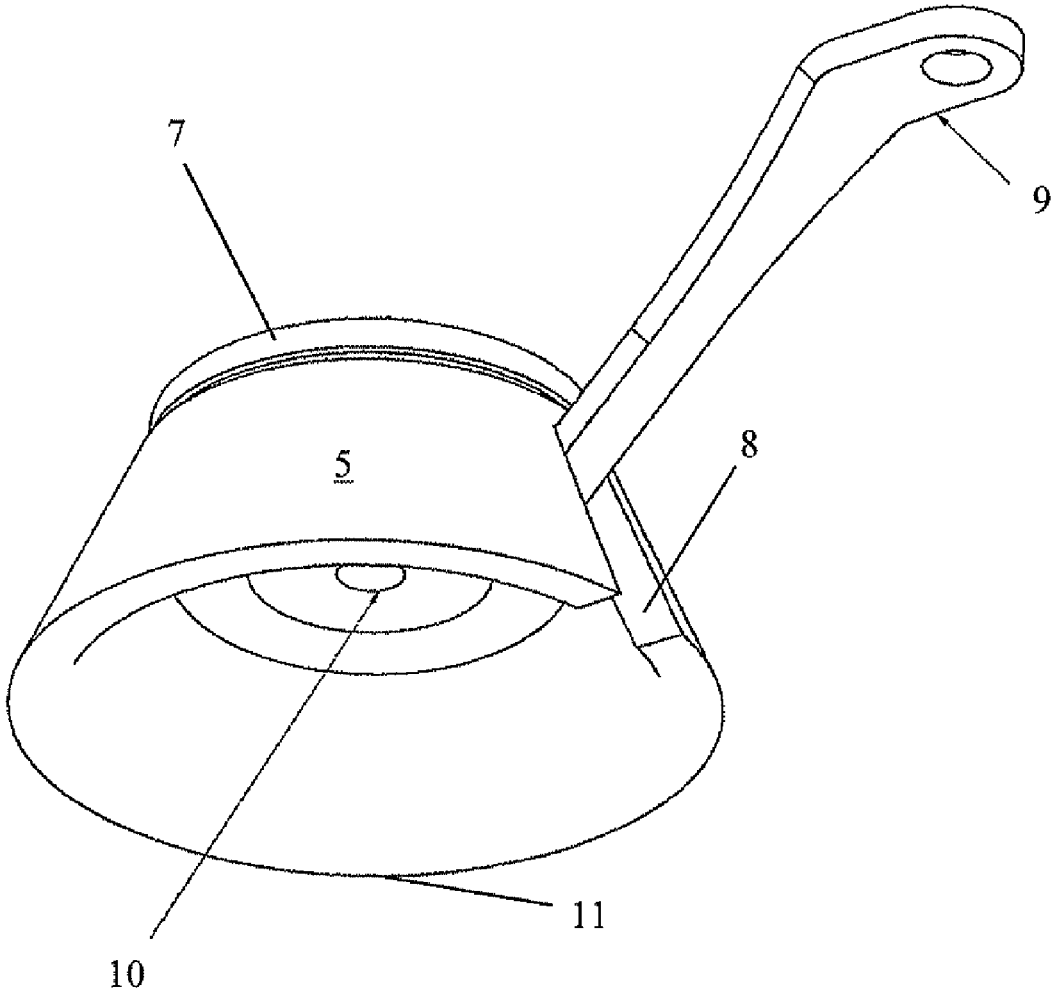
FIG. 2 shows a splatter shield and an arm for height adjustment.

FIG. 2 shows a perspective view of the splatter shield 5 as viewed at an angle from the workpiece 2. The splatter shield 5 has a notch 8 in the side wall 21, through which notch 8 an arm 9 for height adjustment extends. During operation, the arm 9 for height adjustment holds a measurement device (not shown), which measures the distance from the nozzle 6 and the workpiece 2. The present invention also functions without said notch 8 and said arm 9 for height adjustment, respectively.

Figure 3:
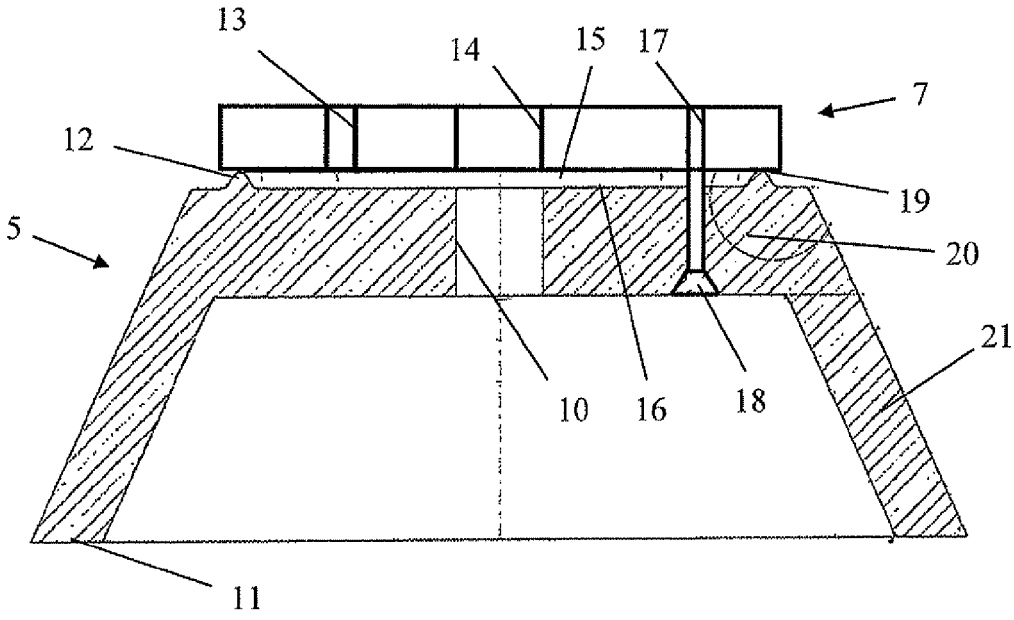
FIG. 3 shows a cross-section through a splatter shield and a support plate in accordance with the present invention.

The upper side 16 of the splatter shield 5, i.e. the closed and away from the workpiece 2 turned end of the cone, is enclosed by a protruding edge or bulge 12, see in particular FIG. 3. An essentially circular support plate 7 is arranged against the bulge 12, whereby the under side 19 of the support plate 7 bears against the upper side of the bulge 12. Since the splatter shield 5 is made from a soft elastic material, the bulge 12 lies sealingly against the support plate 7. The support plate is preferably manufactured from a form stable material, e.g. metal or plastic. The support plate shall be of such form and size that it seals against the bulge in the undeformed condition of the splatter shield.

The nozzle 6 passes through the support plate 7 and the splatter shield 5. The central opening 10 in the upper part 20 of the splatter shield 5, through which the nozzle 6 passes, has a slightly smaller diameter than has the nozzle 6, so that the splatter shield 5 seals against the nozzle 6. Also the support plate 7 is furnished with a central opening 14, through which the nozzle 6 passes. This opening 14 is adjusted for the diameter of the nozzle 6, it is also feasible to arrange a suitable sealing between the central opening 14 of the support plate 7 and the nozzle 6, e.g. in the form of one or more O-rings (not shown). Consequently, an essentially closed space 15 is defined by a boundary surface which is formed by the upper side 16 of the splatter shield 5, the inner side of the bulge 12 of the splatter shield, the under side 19 of the support plate 7, and also the nozzle 6 and any sealings arranged around this.

The support plate is preferably fixed to the splatter shield, which, in turn, is fixed to the nozzle 5. In FIG. 3 is schematically shown how the support plate 7 is fixed to the splatter shield 5 by means of an attachment means 18, which extends through the upper part 20 of the splatter shield and into an opening 17 in the support plate. The attachment means 18 can e.g. be a screw or a bolt, in which case the opening 17 is provided with an inner thread. In order to make sure that the bulge 12 bears sealingly against the under side 19 of the support plate with an even contact pressure along the entire circumference of the bulge, as seen in a plane parallel to the upper part 20 of the splatter shield, a number of attachment devices 18 are preferably arranged. The attachment means 18 are preferably arranged at even intervals along the circumference of the splatter shield and the support plate. For example, three attachment means devices 18 at a mutual distance of 120° in a plane parallel to the upper part 20 of the splatter shield can be put to use. In order to achieve a yet more even contact pressure between the bulge 12 and the under side 19 of the support plate, a larger number of attachment devices 18 can be used.

For reasons that will be clear below, such attachment device 18 should not be arranged at the very outer circumference of the upper part 20 of the splatter shield 5. Such placement of the attachment device 18 would impede the deformation of the splatter shield 5.

Alternatively, the support plate 7 can be attached to the nozzle 6 by a fixing element. Such fixing element includes e.g. adhesive or screw connection.

In order to achieve the essentially closed space described above, other designs of the splatter shield and the support plate are conceivable. For instance, the upper side of the splatter shield may be flat, and a bulge facing the splatter shield may be formed on the support plate. Alternatively, a separate sealing element, such as an O-ring or a gasket, may be arranged between the support plate and the upper side of the splatter shield.

In FIG. 1 the apparatus for water jet cutting with the collision sensing device is shown in its entirety. The support plate 7 comprises an opening 13 for air supply. This opening 13 can e.g. be formed as an internally threaded hole. To the opening 13 a conduit 4 is connected, through which the spacing is provided with a gas, preferably air. The air is provided from a pressure generator (not shown), such as a compressor, as is indicated by the arrow 1 in FIG. 1. The pressure in the conduit 4 is monitored by a pressure monitor 3. In this way the space 15, which is defined by the splatter shield 5 and the support plate 7, can be assigned a monitored static overpressure i.e. a pressure exceeding the ambient pressure. This overpressure thus corresponds to the pressure in the conduit 4. At normal operation the space 15 is supplied with air through the conduit 4, whereby a first pressure P1 prevails in the space 15. Thus, the pressure P1 exceeds the ambient pressure. The overpressure P1 in the space 15 lies within the range 0.1-2 bar, preferably the overpressure P1 lies within the range 0.2-1.5 bar, most preferred is an overpressure of 0.3-0.8 bar.

Alternatively, the pressure generator and the pressure monitor can be connected to the support plate 7 via separate conduits or hoses. The support plate 7 is then modified so as to comprise an opening for supply of air, or another gas, and one opening for pressure measurement. The pressure measurement device can also, instead of being connected via a conduit, be arranged directly on the support plate 7.

During the water jet cutting, the nozzle 6 which is furnished with the splatter shield 5 is driven along the along the workpiece 2 to be machined, or the workpiece 2 is moved while the nozzle 6 with its splatter shield 5 is kept still. This movement of the nozzle 6 or the workpiece 2 is normally performed mechanically following a programmed path. In case an object or an unevenness, which protrudes from the surface of the workpiece 2, is located in or close to the intended path of the nozzle 6, the splatter shield 5, due to the relative movement, will contact this object. Then, due to the relative movement, the splatter shield 5 will deform elastically. Typically, this deformation will imply that the side wall 21 of the splatter shield 5 is pushed in, in a direction essentially perpendicular to the longitudinal axis of the nozzle 6, towards the centre of the frustum of a cone. This impression will cause a displacement of the bulge 12 of the splatter shield, so that the sealing contact with the support plate 7 is broken. Typically, the bulge 12 is displaced downwards in FIG. 1, i.e. towards the surface of the workpiece 2. As the bulge 12 no longer bears against the support plate 7, the space 15 is no longer closed. Now, the air that is supplied to the space 15 via the conduit 4 can flow out through the opening which is formed in the boundary surface of the space 15 upon the deformation of the splatter shield 5, whereby the pressure in the space 15 falls to a second pressure P2. The pressure P2 is thereby lower than the pressure P1, and more precisely the pressure P2 lies between the ambient pressure and the pressure P1, depending on how much the splatter shield 5 is deformed upon the collision with the object, as explained below. Preferably the overpressure P2 amounts to about half of the overpressure P1. The pressure change within the space can be detected by the pressure measurement device 3. Preferably, the pressure measurement device 3 thereby can emit a stop signal which interrupts the mechanical movement of the nozzle 6 or the workpiece 2. In this manner a collision between the nozzle 6 and the object is avoided.

Depending on how fast the movement is interrupted, and which speed the relative movement has, the splatter shield 5 is deformed to a different extent at the contact with an obstacle. If the speed of the relative movement, i.e. the cutting speed, is low and if the movement is interrupted immediately at the smallest change from the pressure P1 within the space 15, the bulge 12 of the splatter shield 5 will only be displaced a short distance from the support plate 7 on collision with an obstacle. In this case, only a small deformation of the splatter shield 5 is allowed and a relatively large remaining distance between the nozzle 6 and the obstacle is ensured. Now, the second pressure P2 will be relatively close to the first pressure P1. By defining in advance the change of pressure to be required by the pressure measurement device in order to emit a stop signal, the distance at which the nozzle 6 shall stop from an imaginary obstacle can be preset.

Thus, with the present arrangement of the deformable member 5, a collision, or a contact with an obstacle, is detected well before the object to be protected, here the nozzle 6, collides with the obstacle. In other words, it is the deformable member 5 that is subject to the collision.

Since the pressure measurement device 3 detects a pressure change, from P1 to P2, upon the splatter shields 5 collision with an object the space 15 need not be completely airtight. The space 15 can be continuously supplied with air, or another gas, from the pressure generator. If the space 15 is not completely airtight, but comprises one or more openings in the boundary surface, the supplied air will continuously leak out. Nonetheless, a first pressure, P1, will prevail in the space which pressure upon deformation of the splatter shield 5, and upon subsequent displacement of the bulge 12 from the support plate 7, will decrease to a second pressure, P2.

Preferably, as mentioned, said pressure generator gives rise to an overpressure, P1, within the space 15. The advantage of keeping an overpressure in the space 15 is that neither dirt nor other unwanted material can enter the space 15 or the pressure generating device or the pressure measurement device 3. However, the invention also functions if the pressure generator gives rise to an underpressure. Upon collision and transition to the second pressure, P2, ambient air would flow into the space 15, and the second pressure, P2, would consequently be higher than the first pressure, P1. An advantage of assigning the space 15 an underpressure is that the underpressure contributes to keeping the space 15 tight, in that the underpressure acts on the elastic splatter shield whereby the bulge 12 is pressed against the support plate 7.

The principle of the invention, to assign an essentially closed space a pressure which is monitored and which is changed as the boundary surface of the space is opened in connection with a deformation of an elastic member due to a contact between two objects, can be put to use in several situations. For instance, such a space could be defined by a relatively soft elastic part of a vehicle bumper. A driver could in this manner be notified upon collision with another object.

When choosing material for the deformable member, the collision force and the sizes of the constituents must be carefully considered, so that the material is sufficiently compliant for the closed pressurized space to open upon a collision, but at the same time rigid enough to resist opening during operation due to other parameters. Examples of such parameters, when the collision sensing device is used in connection with water jet cutting, are acceleration upon change of cutting speed, the presence of loose objects such as grains of sand on the surface of the workpiece, the overpressure within the space, air pressure generated by the cutting beam, material and water splatter from the cutting process et cetera.

That which is claimed:

1. A collision sensing device adapted to detect a collision between two or more objects, comprising:

a deformable member (5) of elastically deformable material which defines a space (15) that assigned a pressure, which the deformable member (5) in a first condition is undeformed whereby the space (15) is assigned a first pressure (P1), and wherein in a second condition the deformable member (5) is deformed whereby the space (15) is assigned a second pressure (P2);

wherein the deformable member (5), upon collision of the deformable member (5) with an object, is deformed into the second condition whereby the pressure in the space (15) changes from the first (P1) pressure to the second pressure (P2); and means (3) for detecting the pressure change.

2. The collision sensing device according to claim 1, wherein the assigned pressure in the space (15) is an overpressure (P1) in the first condition, which pressure falls upon change to the second condition.

3. The collision sensing device according to claim 1, wherein a boundary surface of the space (15) comprises an opening (13), through which the space (15) is assigned the first pressure (P1).

4. The collision sensing device according to claim 1, wherein the device further comprises means for assigning the space (15) an overpressure.

5. The collision sensing device according to claim 1, wherein the space (15) is closed in the first condition, whereas, in the second condition, the space (15) is not closed.

6. The collision sensing device according to claim 1, wherein the deformable member (5) is made from an elastic material with a Shore hardness within the range 75-95.

7. The collision sensing device according to claim 1, wherein the deformable member (5) is a splatter shield which has a form of a frustum of a cone.

8. The collision sensing device according to claim 7, wherein the space (15) is defined by an upper side (16) of the splatter shield (5), a bulge (12) enclosing the upper side (16) of the splatter shield (5) and also a support plate (7) which is sealingly arranged against the bulge (12).

9. The collision sensing device according to claim 1, wherein the deformable member (5) is made from an elastic material with a Shore hardness within the range 85-95.

10. An apparatus for machining, comprising:

a deformable member (5) of elastically deformable material which defines a space (15) that is assigned a pressure, which the deformable member (5) in a first condition is undeformed whereby the space (15) is assigned a first pressure (P1), and wherein in a second condition the deformable member (5) is deformed whereby the space (15) is assigned a second pressure (P2);

wherein the deformable member (5), upon collision of the deformable member (5) with an object, is deformed into the second condition whereby the pressure in the space (15) changes from the first (P1) pressure to the second pressure (P2);

means (3) for detecting the pressure change; and a machining device arranged proximate the deformable number (5).

11. The apparatus according to claim 10, wherein the machining device is water jet cutting device.

* * * * *

UNITED STATES PATENT AND TRADEMARK OFFICE

CERTIFICATE OF CORRECTION

PATENT NO. : 8,176,819 B2
APPLICATION NO. : 12/602978
DATED : May 15, 2012
INVENTOR(S) : Rydh It is certified that error appears in the above-identified patent and that said Letters Patent is hereby corrected as shown below:

In the Specifications:

Column 3

Line 65, "three attachment means devices 18 at a mutual distance of"

should read --three attachment devices 18 at a mutual distance of--

Signed and Sealed this
Seventh Day of May, 2013

Teresa Stanek Rea
*Acting Director of the United States Patent and Trademark Office*